United States Patent [19]

Takazawa

[11] 4,069,553

[45] Jan. 24, 1978

[54] CURTAIN SUSPENDING POSITION MOVER

[76] Inventor: Ietsugu Takazawa, Bancho-Chidorigafuchi Habitation 901, 3 Sanbancho, Chiyodaku, Tokyo, Japan

[21] Appl. No.: 707,509

[22] Filed: July 22, 1976

[30] Foreign Application Priority Data

Aug. 4, 1975 Japan ..... 50-108002[U]

[51] Int. Cl.[2] ..... A44B 21/00

[52] U.S. Cl. ..... 24/73 CH; 16/87.2; 160/348

[58] Field of Search ..... 24/73 CH; 16/87 R, 87.2, 16/93 D, 94 D, 95 D, 96 D; 160/330, 348

[56] References Cited

U.S. PATENT DOCUMENTS

| | | | |
|---|---|---|---|
| 2,115,593 | 4/1938 | Strube | 16/87.2 |
| 2,147,910 | 2/1939 | Martin | 16/87.2 |
| 2,646,116 | 7/1953 | Freeman | 160/348 |
| 2,931,612 | 4/1960 | Graber | 16/87.2 |
| 2,978,735 | 4/1961 | Petzal | 16/87.2 |
| 3,158,914 | 12/1964 | Guarini | 16/87.2 X |
| 3,222,710 | 12/1965 | Potye | 16/87.2 |
| 3,861,001 | 1/1975 | Pape | 16/87.2 X |

FOREIGN PATENT DOCUMENTS

| | | | |
|---|---|---|---|
| 567,394 | 10/1975 | Switzerland | 16/93 D |
| 1,130,450 | 10/1968 | United Kingdom | 160/348 |

*Primary Examiner*—Werner H. Schroeder
*Assistant Examiner*—Moshe I. Cohen
*Attorney, Agent, or Firm*—Holman & Stern

[57] ABSTRACT

In this curtain suspending position mover, on one side of an elastic plate member, cut-out portions are made at regular intervals along its length, a concave portion is made, a fitting portion is made at a proper distance from said concave portion, an inserting portion of a suspender hook is removably fitted and inserted in said fitting portion and a turned portion of said suspender hook is slidably fitted in said concave portion.

2 Claims, 3 Drawing Figures

CURTAIN SUSPENDING POSITION MOVER

BACKGROUND OF THE INVENTION a. Field of the Invention

This invention relates to a curtain suspending position mover whereby the position of suspending a curtain can be moved.

b. Description of the Prior Art

There are already curtain suspending devices wherein a suspender is stitched and fixed in the upper part of a curtain, wherein a suspender hook pointed at one end is thrust through the upper part of a curtain and wherein the upper part of a curtain is resiliently pressed and held with a holding piece. However, there are defects that the curtain hangs down in the pleat parts and extends and contracts. Further, after the curtain is fitted, it is so improper in the height of the lower end as to have to be readjusted and to be troublesome and inconvenient.

SUMMARY OF THE INVENTION

In order to eliminate such defects as are mentioned above, according to the present invention, a suspender fitting which can move a suspending position is provided in the upper part of a curtain.

BRIEF DESCRIPTION OF THE DRAWINGS

The drawings show an embodiment of the present invention.

DESCRIPTION OF THE PREFERRED EMBODIMENT

Figure 1:
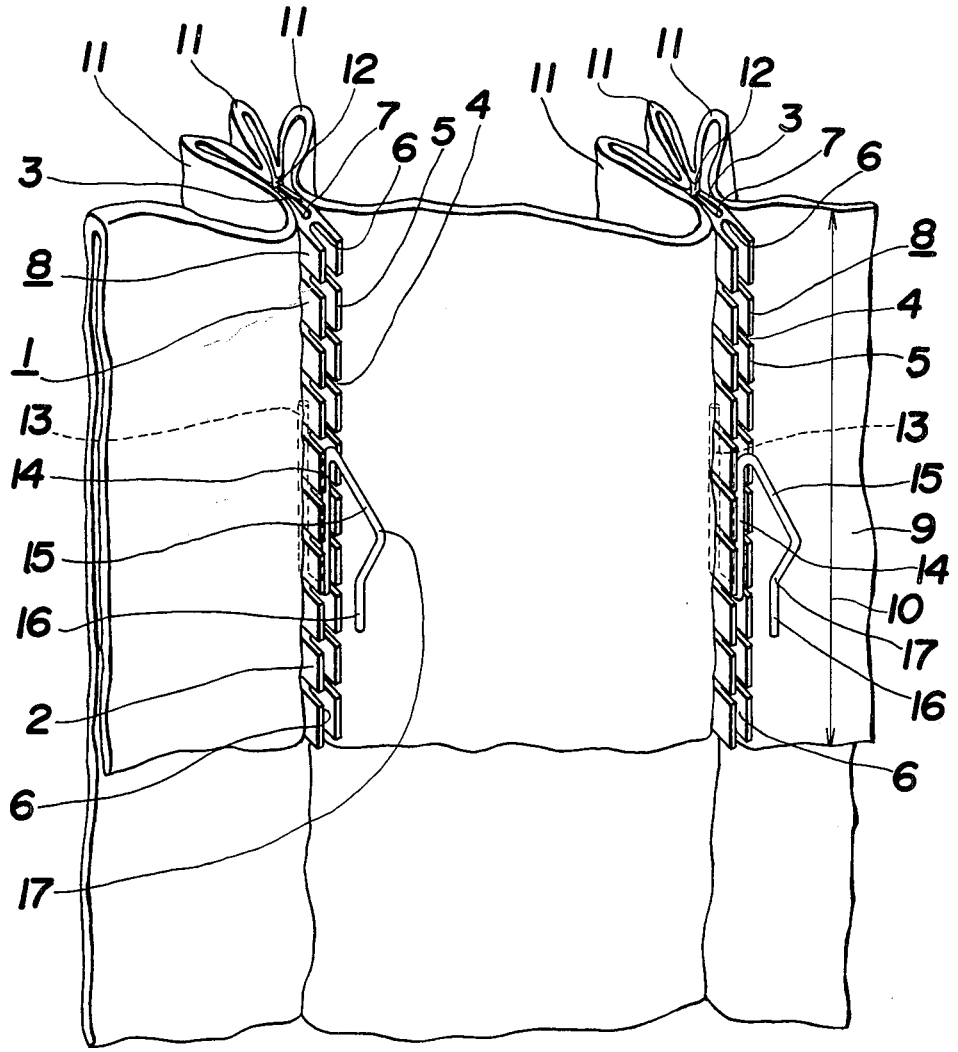
FIG. 1 is a perspective view.
Figure 2:
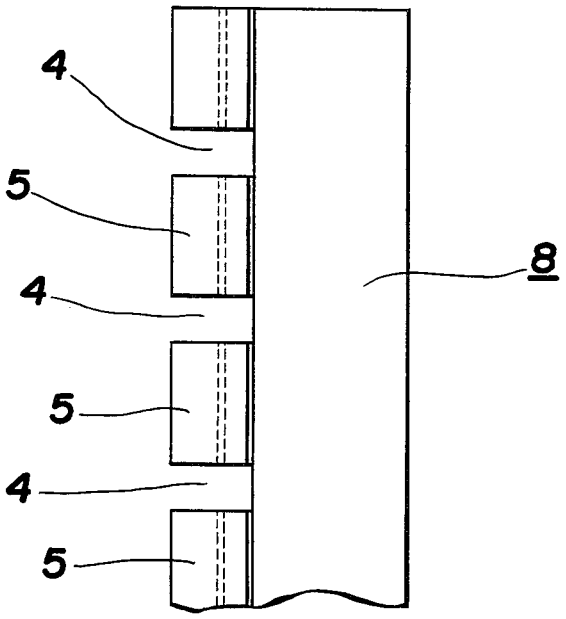
FIG. 2 is a side view.
Figure 3:
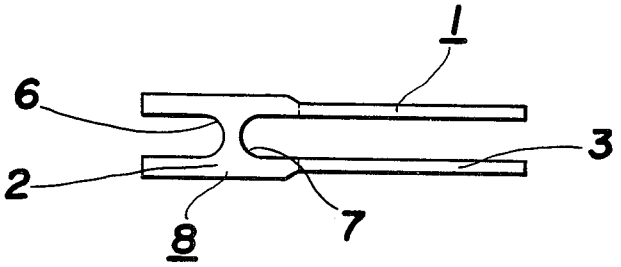
FIG. 3 is a plan view.

An embodiment of the present invention shall be explained with reference to the drawings.

One half part of the width of a narrow long plate member 1 shaped as an H made of an elastic vinyl material is made somewhat thicker than the other half part to provide a thick part 2 and thin part 3. Cut-out portions 4 are made at regular intervals in the lengthwise direction of the thick part so as to form fitting segments. 5 A U-shaped concave portion 6 is made at the free end in the width direction of the thick part 2. A U-shaped fitting portion 7 is made from the free end in the width direction of the thin part 3 to the thick part 2 and a proper distance is provided between the bottom part of the concave portion 6 and the bottom portion of the fitting part 7 so as to form a suspender fitting 8 in the form of an H. The upper part of a curtain 9 is turned back for a proper width 10 from the upper end and is provided with a plurality of vertically bent projecting pleat parts 11 at proper intervals. The thin part 3 of the above mentioned suspender fitting 3 is inserted into a clearance 12 made with said projecting pleat parts 11 and is stitched together with the projecting pleat parts 11 along a pleat line. Then, a suspender hook 17 consisting of an inserting portion 13, a bend portion turned portion 14, hook portion 15 and tip portion 16 is formed by bending a wire material. The hook is bent so that the turned portion 14 may be located in the concave portion 6 of the suspender fitting 8 as stitched in the projecting pleat part 11 with the bend portion supporting the center of the H. The inserting portion 13 is removably fitted and inserted in an upward direction into the fitting portion 7 by passing it through the cut-out portion 4. The turned portion 14 is thus slidably fitted in the concave portion 6 so that the suspender hook 17 may not rotate with respect to the suspender fitting 8.

The operation of the present invention shall be explained in the following. The inserting portion 13 of the suspender hook 17 is fitted in an upward direction into the U-shaped fitting portion 7 of the suspender fitting 8 through the cut-out portion 4 at a position of the same height of said suspender fitting 8 stitched to the upper part of the curtain 9. The turned portion 14 is fitted in the concave portion 6. The tip portion 16 is inserted through a suspending ring of a curtain rail whereby the hook portion 15 is engaged to suspend the curtain 9. In case the height of the lower end of the curtain is improper, the inserting portion 13 of the suspender hook 17 may be pulled out of the fitting portion 7 and may be fitted and inserted upward into another fitting portion 7 through the cut-out portion 4 in another position with the turned portion 14 fitted in the concave portion 6 so as to suspend the curtain at a proper height.

In short, in the present invention, on one side of the elastic plate member 1 the cut-out portions 4 are made at regular intervals, the concave portion 6 is made, the fitting portion 7 is made at a proper distance from said concave portion 6, the inserting portion 13 of the suspender hook 17 is removably fitted and inserted in said fitting portion 7 and the turned portion 14 is slidably fitted in the concave portion 6. Therefore, the suspender hook 17 can be freely fitted to and removed from the curtain 9. Thus it is simple to fit and remove the curtain 9 and the suspending height can be freely adjusted. Since the cut-out portions 4 of the suspender fitting 8 are made at regular intervals, the height of the suspending part of the curtain can be simply made accurate and uniform, Further, as the suspender fitting 8 is stitched to the upper part of the curtain so that the suspender hook 17 may not rotate with respect to the suspender fitting 8, the suspending part will be reinforced, the pleat part will not hang down, the curtain 9 will not contract and the appearance will be good.

I claim:

1. A device for suspending a curtain having pleats along a pleat line with a bent-wire curtain hook having an inserting portion and a turned portion with a bend portion therebetween comprising:

an elastic plate member having a length and being formed laterally as an H, said H having two pairs of legs and a center portion, the first pair of legs being shorter than the second pair, said first pair of legs together with said center portion of said H defining a concave portion, said second pair of legs in the region of said center portion of said H forming a U-shaped fitting portion, the remainder of said second pair of legs being an attachment portion, said concave portion and said fitting portion being notched to form cut-out portions along said length of said plate member at regular intervals, the curtain being suspended by the bent-wire curtain hook being fitted into said plate members such that the inserting portion of the hook is inserted through one of said cut-out portions of said plate member and held in said fitting portion between said second pair of legs, the turned portion of the hook is retained in said concave portion between said first pair of legs, said center portion of said H rests on the bend portion of the hook and said attachment portion is securely sewn to the curtain along the pleat line.

2. The device of claim 1, wherein said center portion of said H, said first pair of legs, and said fitting portion being thicker than said attachment portion.

* * * * *